US007633373B1

(12) United States Patent
Johnson et al.

(10) Patent No.: US 7,633,373 B1
(45) Date of Patent: Dec. 15, 2009

(54) THIN FILM RESISTOR AND METHOD OF FORMING THE RESISTOR ON SPACED-APART CONDUCTIVE PADS

(75) Inventors: Peter Johnson, Sunnyvale, CA (US); Joseph A. De Santis, San Jose, CA (US); Richard Wendell Foote, Jr., Kennedale, TX (US)

(73) Assignee: National Semiconductor Corporation, Santa Clara, CA (US)

( * ) Notice: Subject to any disclaimer, the term of this patent is extended or adjusted under 35 U.S.C. 154(b) by 311 days.

(21) Appl. No.: 11/312,987

(22) Filed: Dec. 19, 2005

(51) Int. Cl.
*H01C 10/00* (2006.01)

(52) U.S. Cl. ..... 338/195; 257/E21.004
(58) Field of Classification Search ..... 338/195
See application file for complete search history.

(56) References Cited

U.S. PATENT DOCUMENTS 5,466,484 A * 11/1995 Spraggins et al. ..... 438/385
7,306,552 B2 * 12/2007 Choi et al. ..... 438/381
2006/0118908 A1 * 6/2006 Erickson et al. ..... 257/536

OTHER PUBLICATIONS

Frederique Ducroquet, et al., "Full CMP Integration of CVD TiN Damascene Sub-0.1um Metal Gate Devices For ULSI Applications", IEEE Transactions On Electron Devices. vol. 48, No. 8, Aug. 2001, pp. 1816-1821.
H. Achard, et al., "Full CMP Integration of TiN Damascene Metal Gate Devices", Proceeding of the 30th European Solid-State Device Research Conference, Sep. 11-13, 2000, pp. 408-411.

* cited by examiner

*Primary Examiner*—Elvin G Enad
*Assistant Examiner*—Joselito Baisa
(74) *Attorney, Agent, or Firm*—Mark C. Pickering

(57) ABSTRACT

A thin film resistor is formed to have very accurately defined dimensions which, in turn, allow the resistive value of the resistor to be very accurately defined. The resistor is formed on spaced-apart conductive pads which, in turn, are electrically connected to conductive plugs that are spaced apart from the resistor.

19 Claims, 9 Drawing Sheets

THIN FILM RESISTOR AND METHOD OF FORMING THE RESISTOR ON SPACED-APART CONDUCTIVE PADS

BACKGROUND OF THE INVENTION

1. Field of the Invention

The present invention relates to thin film resistors and, more particularly, to a thin film resistor and method of forming the resistor on spaced-apart conductive pads.

2. Description of the Related Art

A thin film resistor is a structure that is formed from a conducting resistive material. As with conventionally-formed discrete resistors, thin film resistors are formed to provide a predefined resistance to the flow of current through the semiconductor structure.

FIGS. 1A-1B to 5A-5B show a series of views that illustrate a prior-art method 100 of forming a thin film resistor. FIGS. 1A-5A show a series of plan views, while FIGS. 1B-5B show a series of corresponding cross-sectional views. As shown in FIGS. 1A-1B, method 100 begins with a conventionally-formed layer of insulation material 110, and continues with the deposition of a thin layer of resistor material 112, such as a layer of silicon carbide chrome (SiCCr) or nickel chrome (NiCr), on insulation layer 110.

After resistor material 112 has been deposited, a mask 114 is formed and patterned on resistor material 112. Following this, as shown in FIGS. 2A-2B, the exposed areas of resistor material 112 are etched to form a thin-film resistor 116 from resistor material 112. Once the etch has been completed, mask 114 is removed.

Next, as shown in FIGS. 3A-3B, a first layer of conductive material 120, such as titanium tungsten (TiW), is formed on insulation layer 110 and resistor 116. After this, a second layer of conductive material 122, such as aluminum, is formed on the first layer of conductive material 120.

Once the second layer of conductive material 122 has been formed, a mask 124 is formed and patterned on the second layer of conductive material 122. Following this, as shown in FIGS. 4A-4B, the exposed areas of the second layer of conductive material 122 are anisotropically etched, followed by the anisotropic etching of a portion of the exposed areas of the first layer of conductive material 120 to form an opening 126.

Since the first layer of conductive material 120 is partially removed with an anisotropic (dry) etch, the first layer of conductive material 120 must be sufficiently thick to ensure that the anisotropic etch does not etch through the first layer of conductive material 120 and erode or remove any portion of thin-film resistor 116 that lies underneath.

After the anisotropic etch has been completed, the exposed areas of the first layer of conductive material 120 are isotropically (wet) etched as shown in FIGS. 5A-5B with an etchant that has a high selectivity to the material of resistor 116 until the first layer of conductive material 120 has been removed from the top surface of resistor 116. Following this, mask 124 is removed.

One problem with method 100 is that the first layer of conductive material 120, which has to be sufficiently thick to avoid damage to thin-film resistor 116, must be wet etched for a relatively long period of time (over etched) even though it has been partially etched during the anisotropic etch to ensure that the first layer of conductive material 120 has been completely removed.

If the first layer of conductive material 120 is not completely removed, stringers 128 can remain which, in turn, can short out the resistor. Stringers 128 are tiny strips of the first layer of conductive material 120 which can remain after the first layer of conductive material 120 has been removed from the top surface of resistor 116.

However, the longer the first layer of conductive material 120 is exposed to the isotropic etchant to ensure the removal of stringers 128, the greater the length L1 (the width of the opening shown in FIG. 5B). The length L1 defines the length of resistor 116 which, in turn, defines (in part) the resistance provided by resistor 116. As a result, it becomes difficult to control the resistance provided by resistor 116.

Thus, there is a need for a thin film resistor and method of forming the resistor that reduces variations in the length of the resistor.

BRIEF DESCRIPTION OF THE DRAWINGS

FIGS. 1A-5A are a series of plan views, while FIGS. 1B-5B are a series of cross-sectional views.

FIGS. 6A-17A are a series of plan views, while FIGS. 6B-17B are a series of cross-sectional views.

FIGS. 18A-23A are a series of plan views, while FIGS. 18B-23B are a series of cross-sectional views.

DETAILED DESCRIPTION OF THE INVENTION

FIGS. 6A-6B to 17A-17B show a series of views that illustrate an example of a method 200 of forming a thin film resistor in accordance with the present invention. FIGS. 6A-17A show a series of plan views, while FIGS. 6B-17B show a series of cross-sectional views. As described in greater detail below, the present invention forms a thin film resistor on a pair of spaced-apart conductive pads which, in turn, allows electrical contacts to be made to the conductive pads rather than directly to the resistor.

Figure 6A:
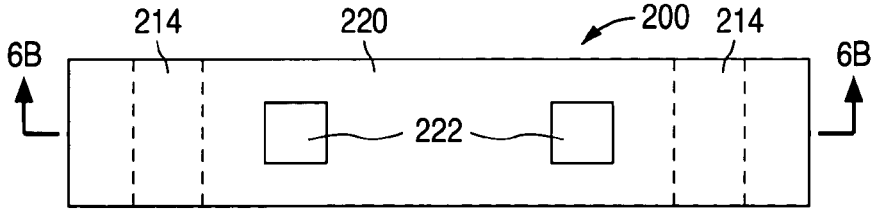
FIGS. 6A-6B to 17A-17B are a series of views illustrating an example of a method 200 of forming a thin film resistor in accordance with the present invention.
Figure 6B:
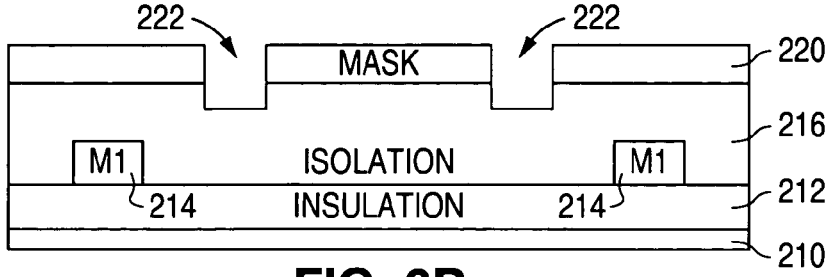

As shown in the FIGS. 6A-6B example, method 200 utilizes a semiconductor wafer 210 which has been conventionally processed to form layer of insulation material 212 on semiconductor wafer 210, a number of metal-1 traces 214 that have been formed on insulation layer 212, and a layer of isolation material 216 that has been formed on insulation layer 212 and the metal-1 traces 214. Isolation layer 216, which has been planarized, can be formed to have a thickness of, for example, 4500 Å.

As further shown in FIGS. 6A-6B, method 200 begins by forming and patterning a mask 220 on the top surface of isolation layer 216. Following this, the exposed regions of isolation layer 216 are etched to remove, for example, 1500 Å of isolation layer 216 to form a pair of spaced-apart openings 222. Each opening 222 can have, for example, a 1 μM diameter. Resist layer 220 is then stripped (e.g., using conventional ashing procedures), and the top surface of isolation layer 216 is cleaned (e.g., using conventional solvents and procedures).

Figure 7A:
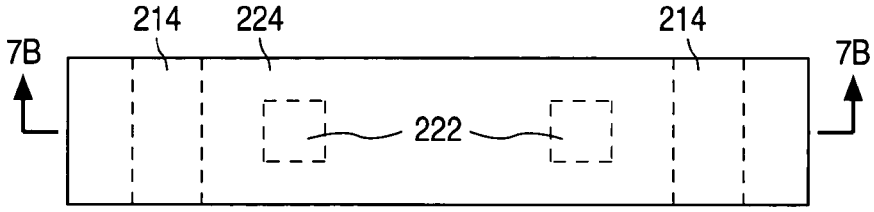
Figure 7B:
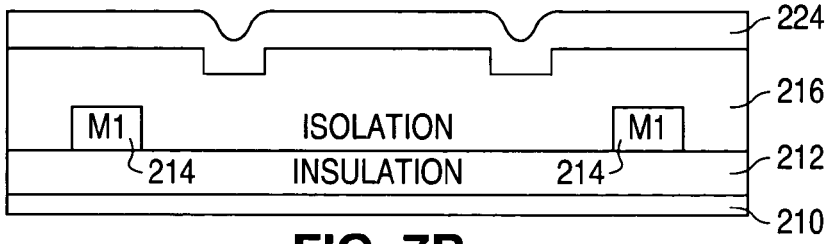

Next, as shown in FIGS. 7A-7B, a metallic layer 224 is formed on the top surface of isolation layer 216 to fill up the openings 222. Metallic layer 224 can be formed from, for example, 50 Å of titanium followed by 1600 Å of titanium nitride. The titanium layer is used to improve adhesion, and can be omitted if the adhesion of the titanium nitride layer is satisfactory. The titanium and titanium nitride layers can be, for example, sputter deposited. In addition, metallic layer 224 can also include an overlying layer of tungsten. The tungsten layer can be deposited by, for example, chemical vapor deposition.

Figure 8A:
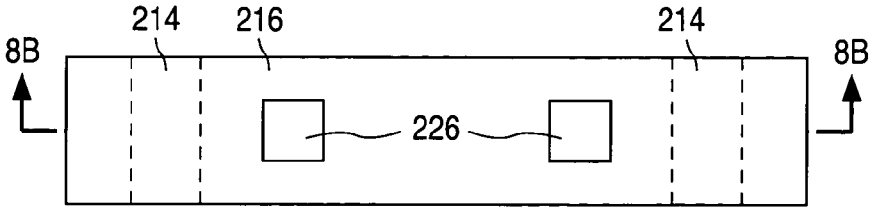
Figure 8B:
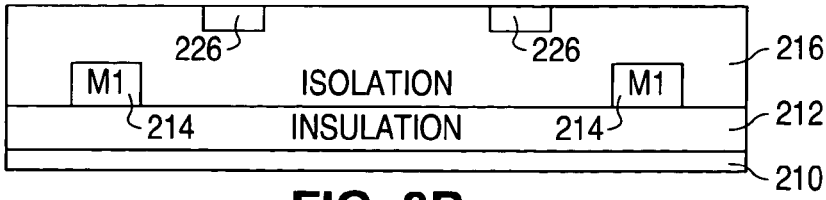

After this, as shown in FIGS. 8A-8B, metallic layer 224 is removed from the top surface of isolation layer 216, along with a portion, such as 500 Å, of the top surface of isolation layer 216 to form a pair of spaced-apart landing pads 226. For example, metallic layer 224 and the portion of the top surface of isolation layer 216 can be removed using conventional chemical mechanical polishing processes. In addition, metallic layer 224 on isolation layer 216 could also be removed by other means than chemical mechanical polishing, for example plasma etching as has been applied to tungsten plugs and polysilicon trench fill.

Thus, in the above example, following the chemical mechanical polishing, the landing pads 226 have 50 Å of titanium and 1100 Å of titanium nitride. (A sputter clean can optionally follow the chemical mechanical polishing to smooth the surface and promote adhesion of the following resistor layer. In this preferred embodiment, the sputter clean is targeted at 50 Å removal.)

Figure 9A:
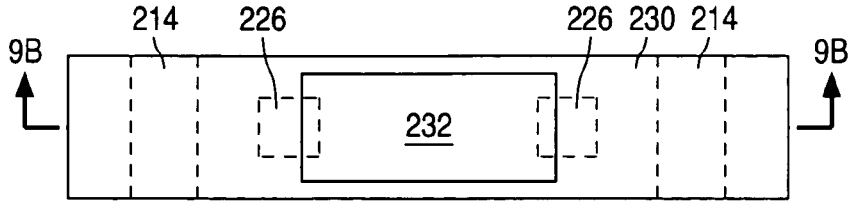
Figure 9B:
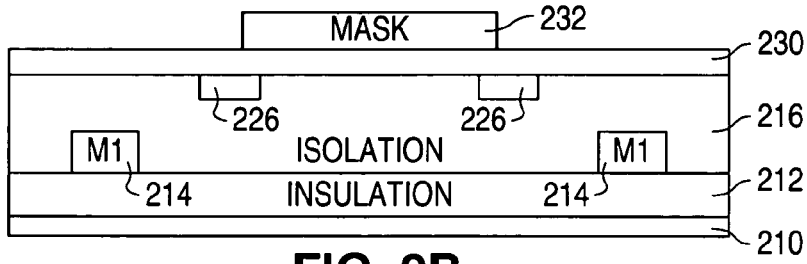

As shown in FIGS. 9A-9B, a layer of resistor material 230, such as silicon carbide chrome or nickel chrome, is then formed on isolation layer 216 and the landing pads 226 to have a thickness of, for example, 75 Å-100 Å, and a resistance of, for example, 1400 ohms/sq, with a 1000 ohms/sq target at the end of fabrication following multiple thermal cycles.

Resistor layer 230 can be formed using, for example, sputter deposition with a low energy power supply at a wafer temperature of 40° C. In addition, the layer of resistor material 230 could be formed by other methods, including but not limited to reactive sputtering, co-sputtering, chemical vapor deposition, or sputtering followed by rapid thermal processing.

Next, a mask 232 is formed and patterned on resistor layer 230 to protect the portion of resistor layer 230 that lies between the landing pads 226, and over an inner region of each of the landing pads 226. The mask grade and photo process preferably accommodate the formation of matching side-by-side resistors with a variation of no more than 0.1% (3 sigma).

Figure 10A:
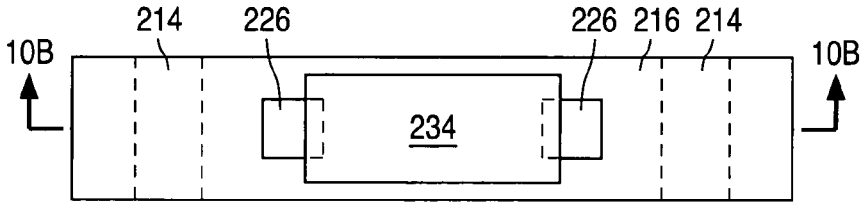
Figure 10B:
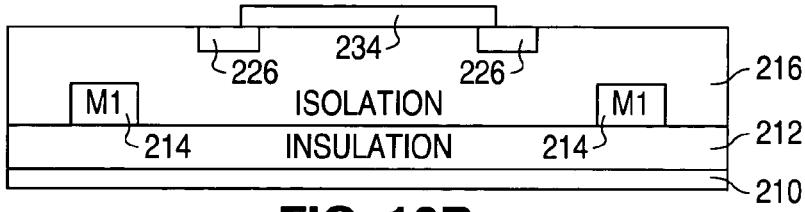

Following this, as shown in FIGS. 10A-10B, the exposed regions of resistor layer 230 are etched to form a resistor 234. Resistor 234 can be, for example, 2-4 μM wide by 20-40 μM long. Resistor layer 230 can be removed using, for example, a plasma etch or a sputter etch. The etch preferably has a reasonable selectivity to titanium nitride and oxide, and removes no more than about 200 Å of the titanium nitride layer from the landing pads 226 when removing 75 Å of resistor layer 230. As noted above, the landing pads 226 can also include a top layer of tungsten if the titanium nitride selectivity is very poor.

Once resistor 234 has been formed, mask 232 is then stripped using, for example, a conventional solvent strip or a nitrogen and hydrogen ($N_2$+$H_2$) gas combination. Mask 232 should not be ashed in oxygen ($O_2$) to prevent damage when a silicon carbide chrome resistor is used.

Figure 11A:
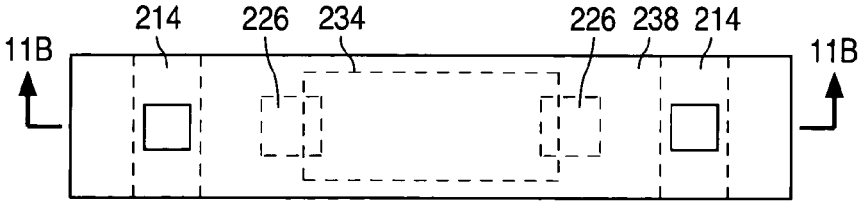
Figure 11B:
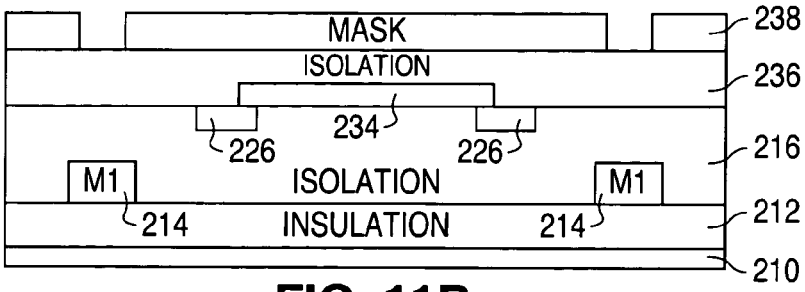

As shown in FIGS. 11A-11B, after mask 232 has been removed, a layer of isolation material 236 is formed on isolation layer 216, the landing pads 226, and resistor 234. For example, isolation layer 236 can be formed by depositing plasma oxide ($SiH_4$) to a thickness of 2500 Å. As a result, the combined thickness of isolation layers 216 and 236 is approximately 6500 Å. After this, a mask 238 is formed and patterned on isolation layer 236.

Figure 12A:
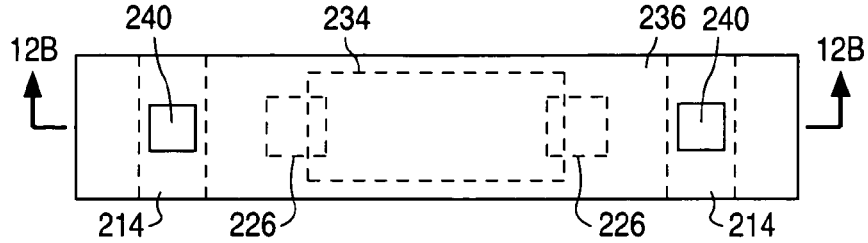
Figure 12B:
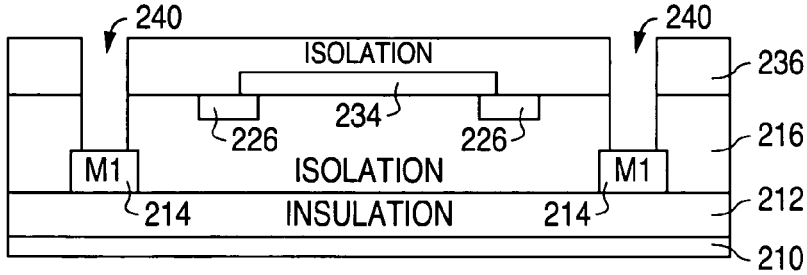
Figure 13A:
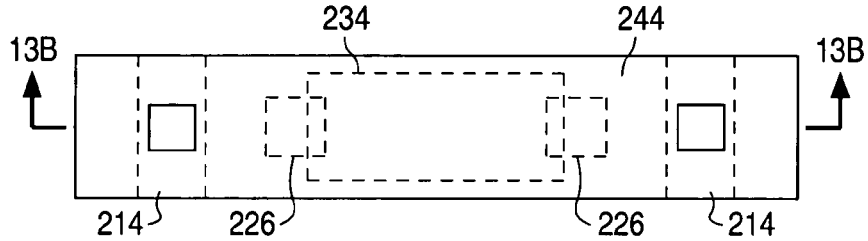
Figure 13B:
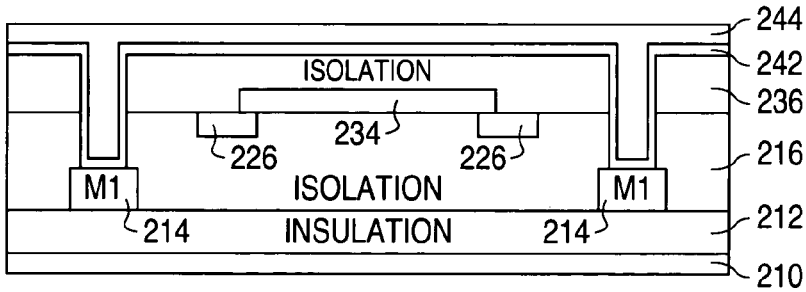

Next, as shown in FIGS. 12A-12B, isolation layer 236 and the underlying isolation layer 216 are etched to form via openings 240 that expose the top surfaces of the metal-1 traces 214. Mask 238 is then removed. As shown in FIGS. 13A-13B, a via liner 242, such as a layer of titanium followed by a layer of titanium nitride, is next formed on isolation layer 236 and in via openings 240, followed by the formation of a layer of tungsten 244 on via liner 242 to fill up via openings 240. In addition, via openings 240 can be filled by other methods, including but not limited to hot aluminum deposition.

Figure 14A:
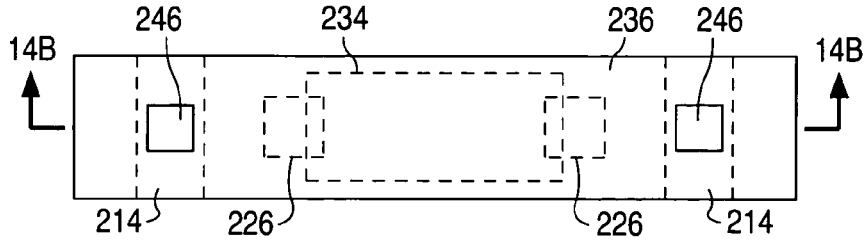
Figure 14B:
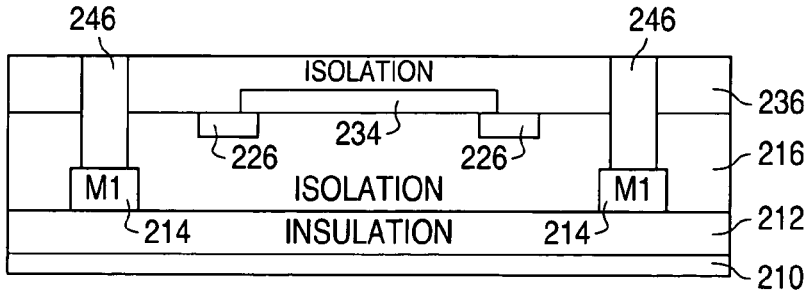

After this, as shown in FIGS. 14A-14B, tungsten layer 244 and via liner 242 are removed from the top surface of isolation layer 236, along with a portion, such as 500 Å, of the top surface of isolation layer 236 to form conductive plugs 246. For example, tungsten layer 244, via liner 242, and the portion of the top surface of isolation layer 236 can be removed using conventional chemical mechanical polishing processes. In addition, tungsten layer 244, via liner 242, and the portion of the top surface of isolation layer 236 can also be removed by other means that chemical mechanical polishing, for example plasma etching as has been applied to tungsten plugs and polysilicon trench fill. Thus, in the above example, following the chemical mechanical polishing, approximately 2000 Å of isolation layer 236 remain over resistor 234.

Figure 15A:
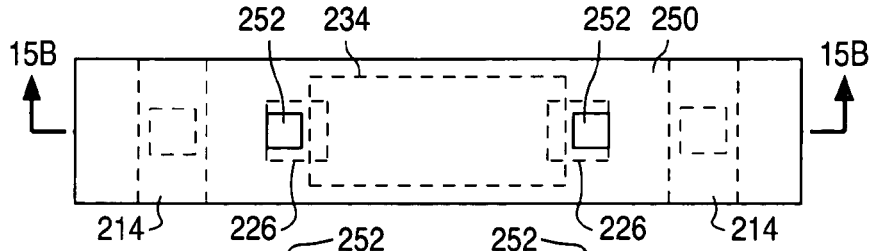
Figure 15B:
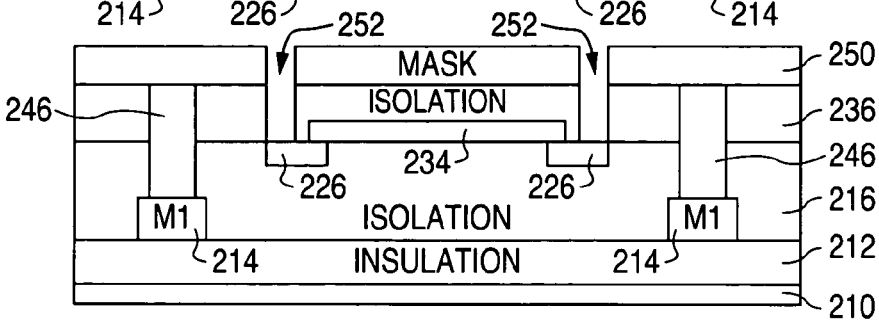

Next, as shown in FIGS. 15A-15B, a mask 250 is formed and patterned on isolation layer 236 and the conductive plugs 246. Isolation layer 236 is then etched to form a pair of resistor openings 252 to expose the top surfaces of the landing pads 226. The resistor openings 252 can be, for example, approximately 0.2 μM deep and 1.0 μM wide. Following this, mask 250 is removed.

Figure 16A:
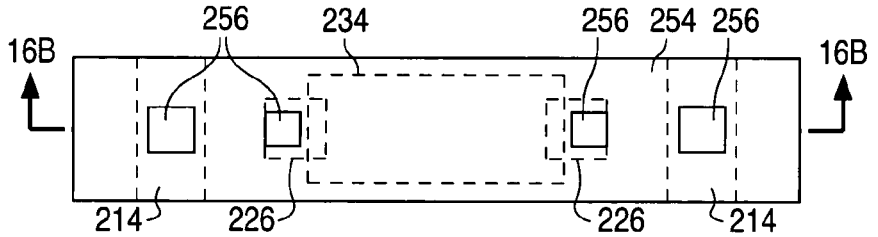
Figure 16B:
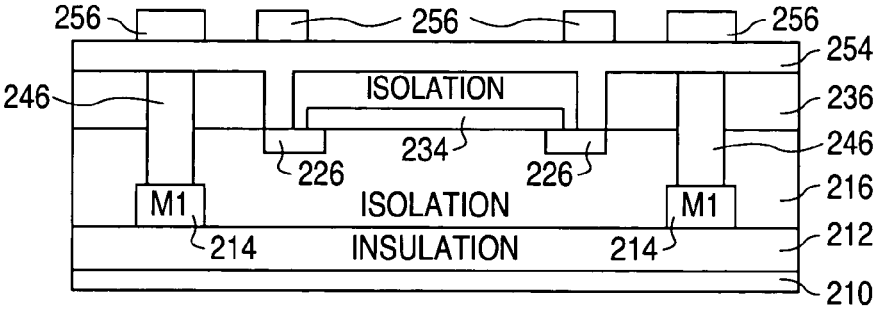
Figure 17A:
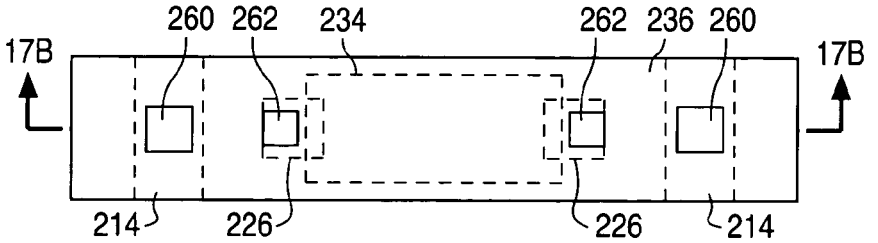
Figure 17B:
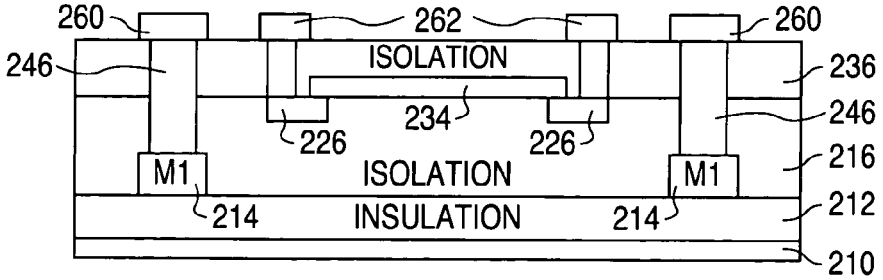

As shown in FIGS. 16A-16B, a metal-2 layer 254 is then formed over isolation layer 236 to fill up resistor openings 252. Once metal-2 layer 254 has been formed, a mask 256 is formed and patterned on metal-2 layer 254. After this, as shown in FIGS. 17A-17B, the exposed regions of metal-2 layer are removed from the top surface of isolation layer 236 to form metal-2 traces 260 that are connected to the conductive plugs 246, and metal-2 traces 262 that are connected to the landing pads 226. Following this, mask 256 is removed. The process then continues with conventional back end processing steps.

FIGS. 18A-18B to 23A-23B show a series of views that illustrate an example of a method 300 of alternately forming a thin film resistor in accordance with the present invention. FIGS. 18A-23A show a series of plan views, while FIGS. 18B-23B show a series of cross-sectional views. Method 300 is similar to method 200 and, as a result, utilizes the same reference numerals to designate the elements and structures which are common to both methods.

Figure 18A:
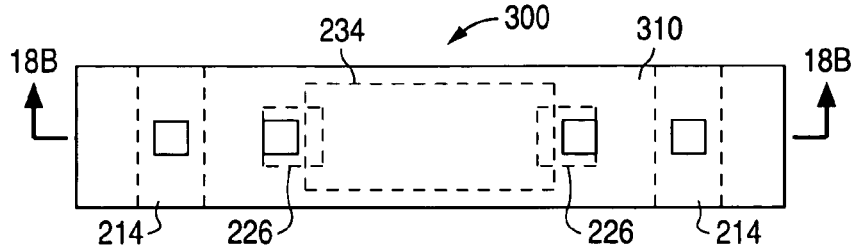
FIGS. 18A-18B to 23A-23B are a series of views illustrating an example of a method 300 of alternately forming a thin film resistor in accordance with the present invention.
Figure 18B:
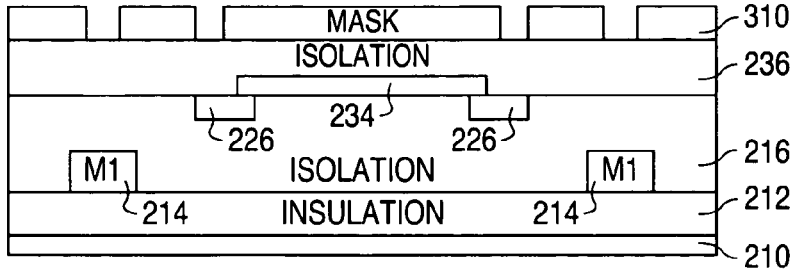

As shown in FIGS. 18A-18B, method 300 is the same as method 200 up through the formation of isolation layer 236, except that the titanium nitride layer of the metallic layer 224 is formed to be, for example, 2000 Å thick as opposed to 1500 Å thick as disclosed in method 200. Following this, rather than forming mask 238, a mask 310 is formed and patterned on isolation layer 236.

Figure 19A:
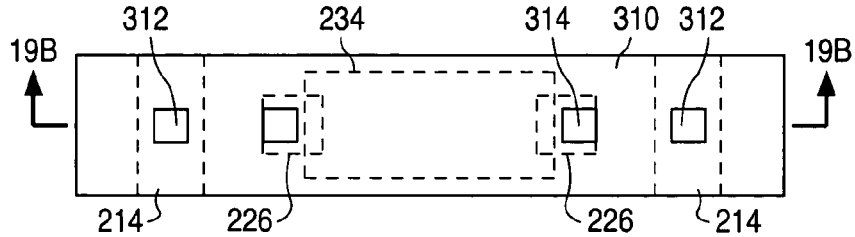
Figure 19B:
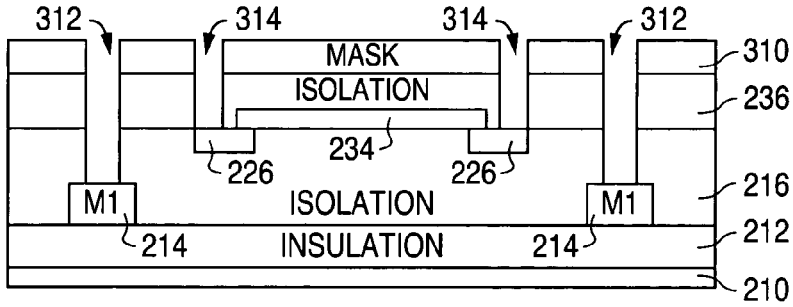

Next, as shown in FIGS. 19A-19B, isolation layer 236 and the underlying isolation layer 216 are etched to form via openings 312 that expose the top surfaces of the metal-1 traces 214. The etch also forms resistor openings 314 in isolation layer 236 that expose the top surfaces of the landing pads 226. Mask 310 is then removed.

Figure 20A:
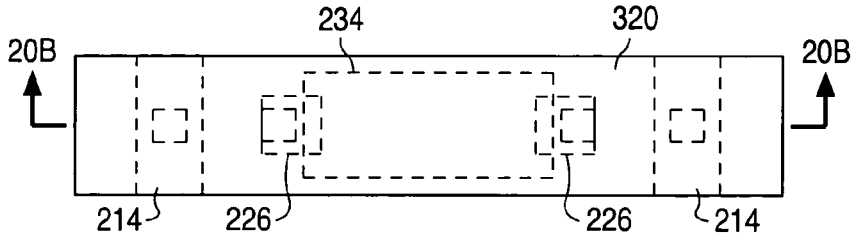
Figure 20B:
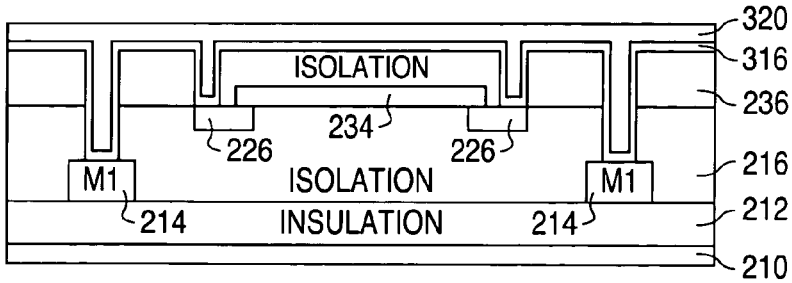

As shown in FIGS. 20A-20B, a liner 316, such as a layer of titanium followed by a layer of titanium nitride, is next formed over isolation layer 236 and in the via openings 312 and resistor openings 314, followed by the formation of a layer of tungsten 320 on liner layer 316 to fill up the via openings 312 and resistor openings 314. In addition, via openings 312 and resistor openings 314 can be filled by other methods, including but not limited to hot aluminum deposition.

Figure 21A:
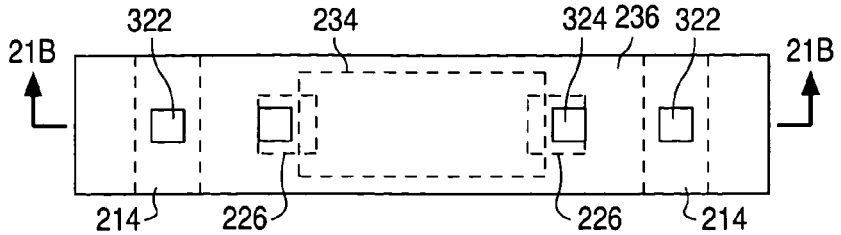
Figure 21B:
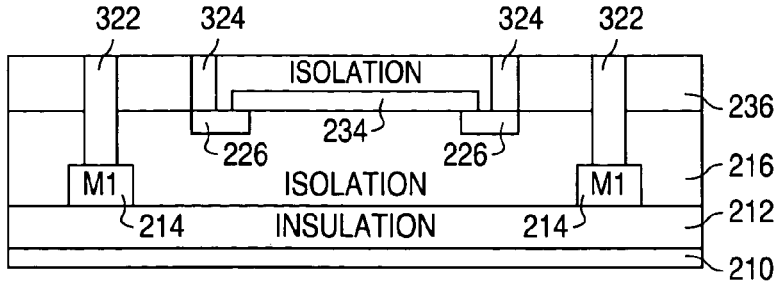

After this, as shown in FIGS. 21A-21B, tungsten layer 320, and liner layer 316 are removed from the top surface of isolation layer 236, along with a portion, such as 500 Å, of the top surface of isolation layer 236 to form conductive plugs 322 that are connected to the metal-1 traces 214, and resistor plugs 324 that are connected to the landing pads 226.

For example, tungsten layer 320, liner layer 316, and the portion of the top surface of isolation layer 236 can be removed using conventional chemical mechanical polishing processes. In addition, tungsten layer 320, liner layer 316, and the portion of the top surface of isolation layer 236 can also be removed by other means that chemical mechanical polishing, for example plasma etching as has been applied to tungsten plugs and polysilicon trench fill.

Figure 22A:
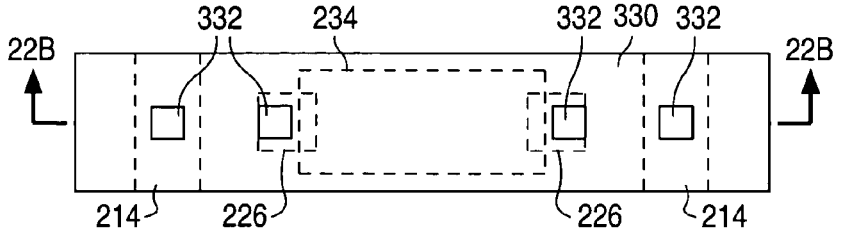
Figure 22B:
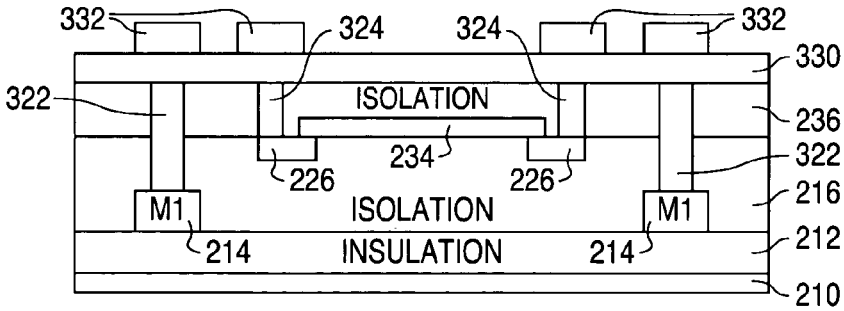
Figure 23A:
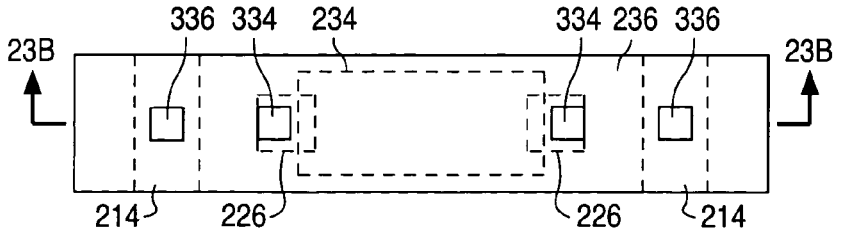
Figure 23B:
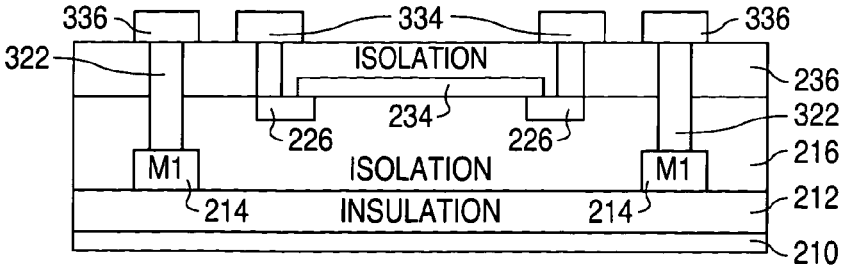

Next, as shown in FIGS. 22A-22B, a metal-2 layer 330 is then formed over isolation layer 236, the conductive plugs 322, and the resistor plugs 324. Once metal-2 layer 330 has been formed, a mask 332 is formed and patterned on metal-2 layer 330. After this, as shown in FIGS. 23A-23B, the exposed regions of metal-2 layer are removed from the top surface of isolation layer 236 to form metal-2 traces 334 that are connected to the resistor plugs 324 and metal-2 traces 336 that are connected to the conductive plugs 322. Following this, mask 332 is removed. The process then continues with conventional back end processing steps.

Figure 1A:
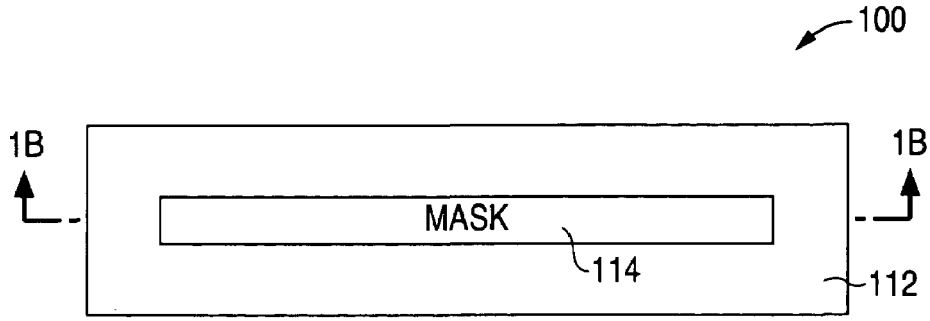
FIG. 1A (PRIOR ART)
FIGS. 1A-1B to 5A-5B are a series of views illustrating a prior-art method 100 of forming a thin film resistor.
Figure 1B:
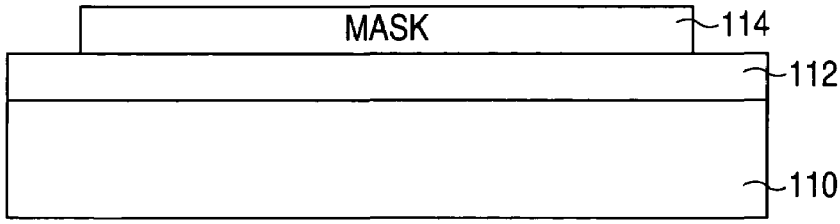
FIG. 1B (PRIOR ART)
Figure 2A:
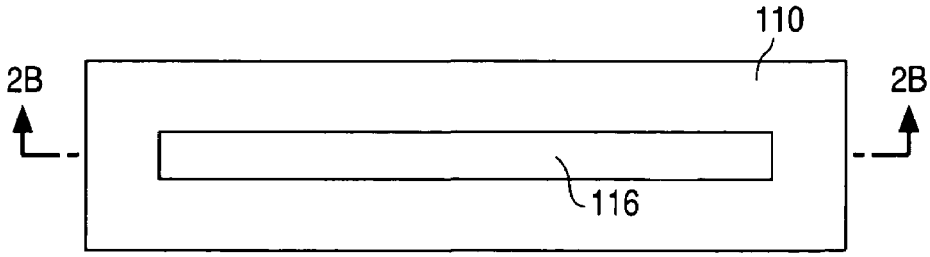
FIG. 2A (PRIOR ART)
Figure 2B:
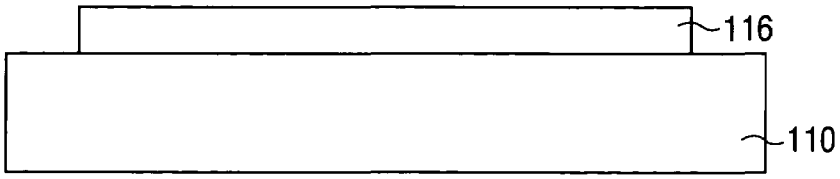
FIG. 2B (PRIOR ART)
Figure 3A:
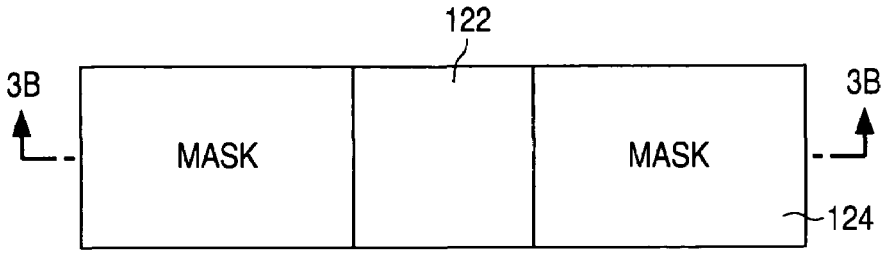
FIG. 3A (PRIOR ART)
Figure 3B:
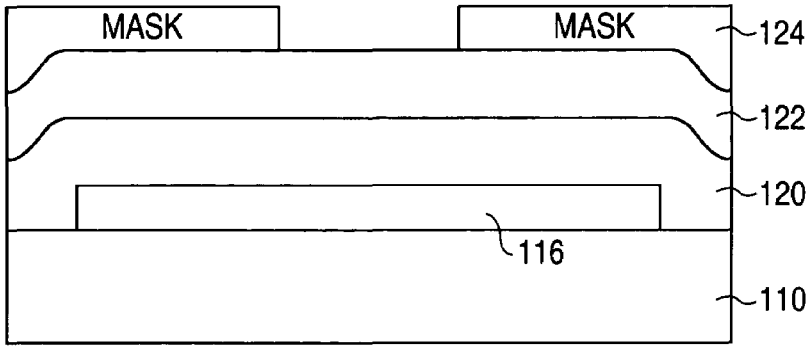
FIG. 3B (PRIOR ART)
Figure 4A:
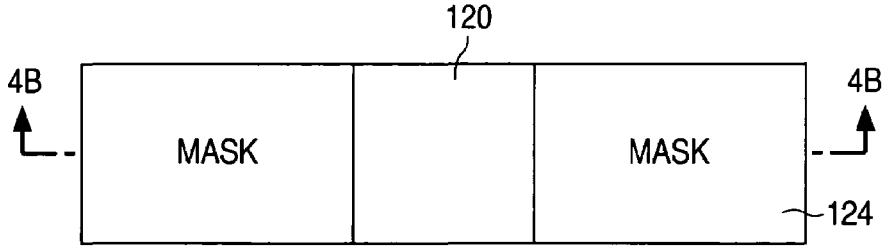
FIG. 4A (PRIOR ART)
Figure 4B:
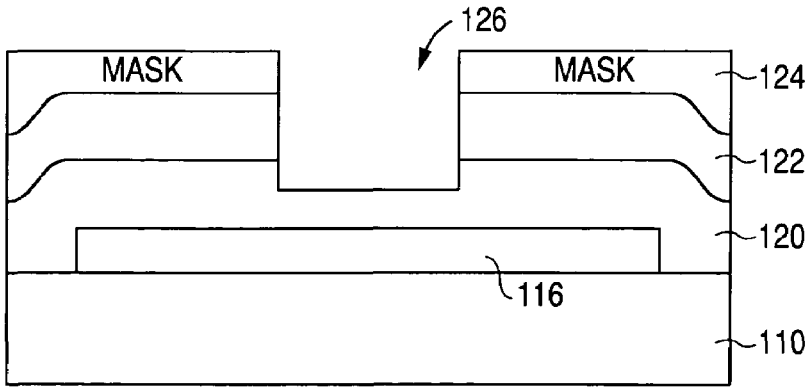
FIG. 4B (PRIOR ART)
Figure 5A:
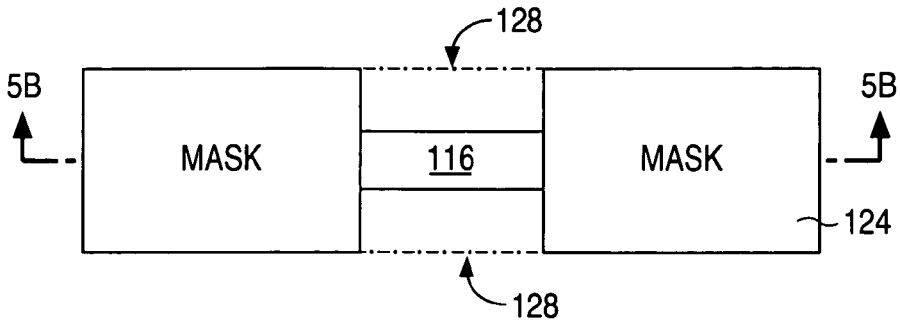
FIG. 5A (PRIOR ART)
Figure 5B:
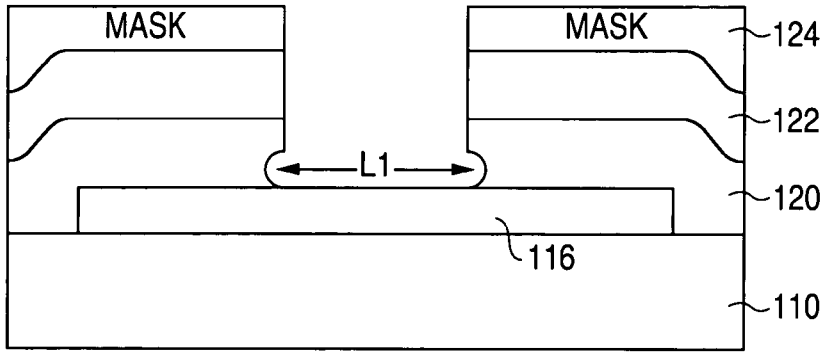
FIG. 5B (PRIOR ART)

One of the advantages of the present invention is that the present invention eliminates the need to wet etch the overlying electrical contact, such as conductive layer 120 shown in FIG. 5B, to ensure the removal of stringers. Thus, the variation in resistor length that results from the wet overetch to remove stringers is eliminated. As a result, the method of the present invention provides a process of forming resistors with highly accurate and matched dimensions.

In addition, as shown in FIGS. 17B and 23B, no metal-1 trace lies above or below resistor 234. This is to ensure that there are no external influences present for critical resistor matching applications. On the other hand, for non-critical applications, metal traces can lie above and/or below resistor 234.

It should be understood that the above descriptions are examples of the present invention, and that various alternatives of the invention described herein may be employed in practicing the invention. For example, although resistor 234 is illustrated as formed below the metal-2 layer, resistor 234 can be formed below any metal layer.

In addition, although the present invention has been disclosed with resistor 234 extending from one conductive landing pad 226 to another conductive landing pad 226 via a straight line, resistor 234 can alternately extend from one conductive landing pad 226 to another conductive landing pad 226 via any path, such as via a serpentine path.

Figure 24:
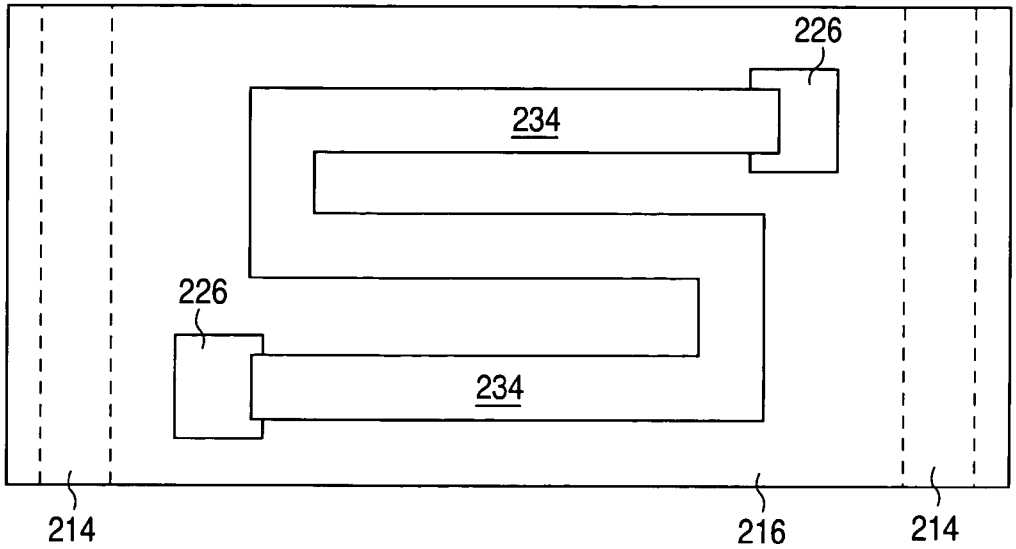
FIG. 24 is a plan view similar to FIG. 9A illustrating resistor 234 in accordance with an alternate embodiment of the present invention.

FIG. 24 shows a plan view similar to FIG. 9A that illustrates resistor 234 in accordance with an alternate embodiment of the present invention. As shown in FIG. 24, resistor 234 extends from one conductive landing pad 226 to another conductive landing pad 226 via an S-shaped path. Thus, it is intended that the following claims define the scope of the invention and that structures and methods within the scope of these claims and their equivalents be covered thereby.

What is claimed is:

1. A method of forming a thin film resistor on a semiconductor wafer, the method comprising:

forming a first isolation layer over the semiconductor wafer;

forming spaced-apart first and second conductive landing pads that touch the first isolation layer, the first isolation layer having a top surface, the first and second conductive landing pads having top surfaces;

forming a resistive region having a bottom surface that touches the top surface of the first isolation layer and the top surfaces of the first and second conductive landing pads, the top surface of the first conductive landing pad, the top surface of the second conductive landing pad, and substantially all of the bottom surface of the resistive region lying in a single plane;

forming a second isolation layer that touches the resistive region and the spaced-apart first and second conductive landing pads, the second isolation layer having a top surface; and making electrical connections with the spaced-apart first and second conductive landing pads through the second isolation layer.

2. The method of claim 1 wherein forming spaced-apart first and second conductive landing pads includes:

forming spaced-apart openings in the top surface of the first isolation layer;

forming a metallic layer that touches the top surface of the first isolation layer to fill up the spaced-apart openings; and removing the metallic layer from the top surface of the first isolation layer to leave the spaced-apart first and second conductive landing pads.

3. The method of claim 2 wherein the metallic layer includes titanium nitride.

4. The method of claim 2 wherein the metallic layer includes titanium nitride and tungsten.

5. The method of claim 1 wherein forming a resistive region includes:

forming a layer of resistive material that touches the top surface of the first isolation layer and the spaced-apart first and second conductive landing pads; and removing the layer of resistive material from a portion of the top surface of the first isolation layer and portions of the spaced-apart first and second conductive landing pads to leave the resistive region, the resistive region covering a portion of each of the spaced-apart first and second conductive landing pads and a section of the first isolation layer that lies between the spaced-apart first and second conductive landing pads.

6. The method of claim 5 wherein the layer of resistive material includes silicon carbide chrome.

7. The method of claim 5 wherein the resistive region extends along a straight line from the first conductive landing pad to the second conductive landing pad.

8. The method of claim 5 wherein the resistive region extends along a serpentine line from the first conductive landing pad to the second conductive landing pad.

9. The method of claim 5 wherein making an electrical connection includes:

forming spaced-apart openings in the second isolation layer, the spaced-apart openings exposing the spaced-apart first and second conductive landing pads;

forming a metallic layer on the top surface of the second isolation layer to fill up the openings; and removing portions of the metallic layer from the top surface of the second isolation layer to form first and second conductive connectors that make electrical connections to the spaced-apart first and second conductive landing pads, the first and second conductive connectors being spaced apart from the resistive region.

10. The method of claim 1 wherein the semiconductor wafer further includes a metal trace formed over the semiconductor wafer, the first isolation layer and the second isolation layer lying over the metal trace.

11. The method of claim 10 wherein making an electrical connection includes:

forming a first opening through the first and second isolation layers to expose the metal trace, and second openings through the second isolation layer to expose the spaced-apart first and second conductive landing pads;

forming a metallic layer on the top surface of the second isolation layer to fill up the first and second openings; and removing the metallic layer from the top surface of the second isolation layer to form a first conductive plug that makes an electrical connection with the metal trace, and second conductive plugs that make electrical connections to the spaced-apart first and second conductive landing pads, the second conductive plugs being spaced apart from the resistive region.

12. The method of claim 10 wherein making an electrical connection includes:

forming a first opening through the first and second isolation layers to expose the metal trace;

forming a first metallic layer on the top surface of the second isolation layer to fill up the first opening;

removing the first metallic layer from the top surface of the second isolation layer to form a conductive plug that makes an electrical connection with the metal trace;

forming second openings through the second isolation layer to expose the spaced-apart first and second conductive landing pads;

forming a second metallic layer on the top surface of the second isolation layer and the conductive plug to fill up the second openings; and removing portions of the second metallic layer from the top surface of the second isolation layer to form a metal trace that contacts the conductive plug, and metal traces that electrically contact the spaced-apart first and second conductive landing pads.

13. A thin film resistor comprising:

a first isolation region formed over a semiconductor wafer, the first isolation region having a top surface;

a first conductive landing pad having a bottom surface and a top surface;

a second conductive landing pad having a bottom surface and a top surface;

a resistive region having a bottom surface that touches the top surface of the first isolation region, the top surface of the first conductive landing pad, and the top surface of the second conductive landing pad, the top surface of the first conductive landing pad, the top surface of the second conductive landing pad, and substantially all of the bottom surface of the resistive region lying in a single plane;

a second isolation region that touches the top surface of the resistive region, the top surface of the first conductive landing pad, and the top surface of the second conductive landing pad;

a first metallic region that touches the top surface of the first conductive landing pad; and a second metallic region that touches the top surface of the second conductive landing pad.

14. The thin film resistor of claim 13 wherein the resistive region follows a straight path from the first conductive landing pad to the second conductive landing pad.

15. The thin film resistor of claim 13 wherein the resistive region follows a serpentine path from the first conductive landing pad to the second conductive landing pad.

16. The thin film resistor of claim 13 wherein the first and second metallic regions are spaced apart from the resistive region.

17. The thin film resistor of claim 16 wherein the resistive region includes silicon carbide chrome.

18. The thin film resistor of claim 16 wherein the semiconductor wafer further includes:

a metal trace formed over the semiconductor wafer, the first isolation region and the second isolation region lying over the metal trace;

a conductive plug formed through the first isolation region and the second isolation region to make an electrical connection with the metal trace;

a first metal line that contacts the second isolation region and the conductive plug; and a second metal line that contacts the second isolation region and the first metallic region.

19. The thin film resistor of claim 13 wherein the first isolation region touches the bottom surface of the first conductive landing pad, and the bottom surface of the second conductive landing pad.

* * * * *